United States Patent [19]

Lonati

[11] 4,022,035

[45] May 10, 1977

[54] PANTY HOSE WAIST OPENING

[76] Inventor: Francesco Lonati, Via Valsorda, 28, Brescia, Italy

[22] Filed: Sept. 6, 1974

[21] Appl. No.: 503,838

Related U.S. Application Data

[63] Continuation-in-part of Ser. No. 305,632, Nov. 10, 1972, Pat. No. 3,924,423.

[30] Foreign Application Priority Data

Sept. 10, 1973 Italy ..... 5178/73

[52] U.S. Cl. ..... 66/177; 66/172 E

[51] Int. Cl.[2] ..... D04B 9/42; A41B 9/14

[58] Field of Search ..... 66/177, 176, 175, 172 E, 66/172 R

[56] References Cited

UNITED STATES PATENTS

| | | | |
|---|---|---|---|
| 3,006,175 | 10/1961 | Morgan | 66/177 |
| 3,208,242 | 9/1965 | Fors | 66/177 |
| 3,748,870 | 7/1973 | Fregeolle | 66/177 |

FOREIGN PATENTS OR APPLICATIONS

| | | | |
|---|---|---|---|
| 2,182,374 | 12/1973 | France | 66/177 |
| 2,206,762 | 6/1974 | France | 66/177 |
| 1,809,378 | 6/1970 | Germany | 66/177 |
| 1,935,030 | 1/1971 | Germany | 66/177 |

OTHER PUBLICATIONS

*Knitted Outerwear Times*, Jan. 26, 1970, vol. 39, No. 4, p. 36.

*The Hosiery Trade Journal*, June 1973, vol. 80, No. 954, pp. 99, 100.

*Primary Examiner*—Mervin Stein

*Assistant Examiner*—Andrew M. Falik

*Attorney, Agent, or Firm*—Guido Modiano; Albert Josif

[57] ABSTRACT

A method for manufacturing seamless panty hose having two tubular legs knitted by continuously rotating the needle cylinder and a panty portion between the legs knitted by reciprocatingly operating the needle cylinder. During manufacturing of the central part of the panty portion a number of adjacent needles is inactivated at the end of each stroke of reciprocation and the last of the working needles are controlled to form a knit selvage edge at the sides of the inactivated group of needles extending longitudinally with respect to the knitted fabric, the opposite selvage edges being spaced by an extent corresponding to the extent of the arc of the needle cylinder occupied by the inactivated needles. The number of inactivated needles is such as to define between the two opposite selvage edges a rectangular waist opening having proportioned sides.

2 Claims, 3 Drawing Figures

PANTY HOSE WAIST OPENING

This is a continuation-in-part of my U.S. Pat. application No. 305,632 filed on Nov. 10, 1972, now U.S. Pat. No. 3,924,423. BACKGROUND OF THE INVENTION

This invention relates to a method for manufacturing seamless panty hose in a fully automatic and mechanical way on an industrial basis.

The parent U.S. Pat. No. 3,924,423 discusses the prior art in some detail and discloses a new approach to making panty hose with an automatic process, which are entirely finished even around their waist opening, feasible with a single pass or run in a suitably adapted machine. Accordingly, reference is made to that patent and only a few remarks are offered herein for a better understanding of the present invention.

The parent patent invention utilizes essentially prior art techniques to produce panty hose on a circular knitting machine which are formed as a continuous tube from one toe end to the other, and are subsequently subjected to a cutting operation for obtaining the waist opening and to the sewing of an elastic band around said opening, and intoduces a method of obtaining already hemmed and run-proofed on the same circular machine, which is made to operate in a reciprocating mode of operation across said opening. The parent patent invention thus provides a slit tubular knitted structure.

Although the above method was entirely successful in attaining the object of a fully automatic manufacturing process, there still remains scope for further development, specially for what concern a reduction of the production times.

SUMMARY OF THE INVENTION

A primary object of this invention, therefore, is to reduce the production time and cost for lower body garments of the panty hose type.

Another object of the invention is to provide an improved method of manufacturing panty hose which reduces the product time of residence in the machine while using substantially known machines and techniques.

A further object of the invention is to produce panty hose of lower cost with improved close-fitting characteristics in comparison to prior automatically manufactured garments.

These and other objects such as will become more apparent hereinafter are attained by panty hose obtained with a fully automatic mechanical process according to the invention, and comprising a hemmed waist opening formed by operating a circular knitting machine in the reciprocating mode, said waist opening being configurated such as to have at least four sides cooperating to define a transverse extension for said opening, a substantially uniform selvedge being formed along the periphery of said opening without unravelling the free sides. For the manufacturing of such panty hose, the invention provides a method comprising the steps of first knitting one leg part on a circular machine with the needle cylinder in the constant revolving mode, then a center portion integral with said first leg in the reciprocating mode, and finally the other leg part integral with said center portion, again in the revolving mode and continuously, at said center portion edge portions being formed for said opening which are spaced apart transversally, by holding inoperative a number of needles, thereby defining an opening which extends transversally, the reciprocating mode knitting step operation being carried out longitudinally with respect to the hose for a distance proportioned to said transverse extension.

BRIEF DESCRIPTION OF THE DRAWINGS

The features and advantages of the invention will appear more clearly from the following description of a preferred though not exclusive embodiment thereof, provided by way of example only and to be taken in conjunction with the accompanying drawings, wherein.

DESCRIPTION OF A PREFERRED EMBODIMENT

The invention stems from the observation that a major factor which slows down production resides in the unavoidable reduction of the production speed which occurs in the manufacturing of the knitted article during the reciprocating mode of operation with respect to the production speed during the continuous revolving mode in a given machine. Such slowing down is mainly attributable to the reduction in speed due to the periodical halting required to reverse the needle cylinder direction of motion.

From the above considerations, it appears that it is highly desirable that the length or distance, as measured along the centerline of the knitted tube forming the hose, wherethrough the machine is to operate in the reciprocating mode be minimized. That distance corresponds, in the parent patent, to the length of the cut plus two bands, ahead of the cut and after it. According to the invention, it is contemplated that said opening length be reduced while leaving its perimeter substantially unvaried which is the value actually imparted to the finished article. The invention contemplates a reduction in the opening length, formerly provided as a linear cut, by conferring to the opening a foursided configuration such as to ensure consistent width as well as length. The length thus becomes proportioned to the width. More particularly, the opening may have a rectangular shape, thus obtaining a reduction in length equal to the width dimension. Obviously, this modification is not simply a matter of shape and involves the solution of various problems connected with the knitting process, and a new method of operation which will be described in detail hereinafter. The basic concept appears illustrated in FIG. 1 and 2, which compare two different panty hose waist openings, one according to the prior art (FIG. 1) and the other according to the invention (FIG. 2).

Figure 1:
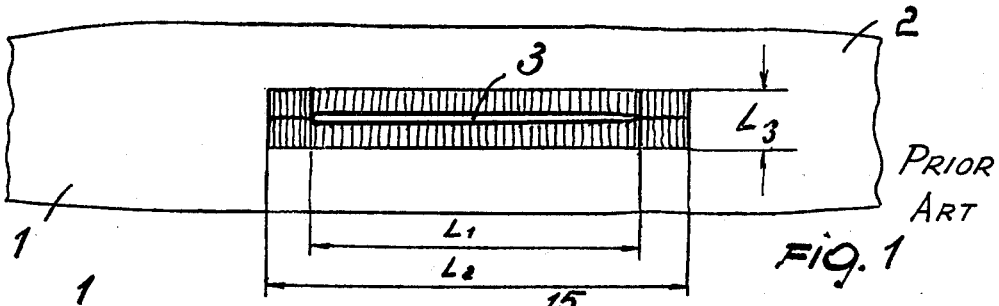
FIG. 1 is a plan view of the opening portion in a prior art panty hose.
Figure 2:
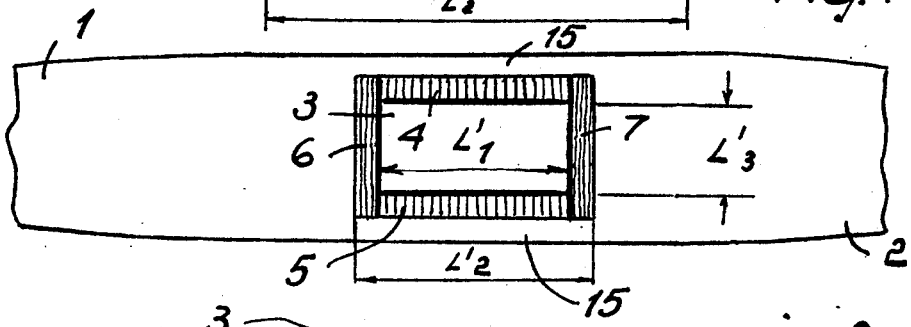
FIG. 2 is a plan view of the opening portion in the panty hose according to the invention.

The reference numerals 1 and 2 identify respectively a first and second leg of a hose pair, the numeral 3 indicates, in each figure, an opening which is linear in FIG. 1 and rectangular in FIG. 2. The relating edges are indicated with the numerals 4, 5, 6 and 7, and their respective lengths are indicated as $L_1$,$L_2$,$L_3$ and $L'_1$,$L'_2$, $L'_3$. It should be noted that the length of the portion requiring reciprocation $L'_2$ is reduced in the present invention by $L'_3$, for a given opening perimeter, with respect to the previous $L_2$.

Putting, for example, $L'_3$ equal to 40 percent of $L_2$, and knowing that the comparatively short reciprocation portion with respect to continuous revolution substantially affects the overall machine time, a 25% reduction of that time may be obtained. Yet another advantage of the invention, however, becomes apparent: since the opening approaches more closely the form of the human waist around which it has to fit, the elastic edge or band formed by the areas 4–7 (FIG. 2) is subjected to a much more uniformly applied deformation, and thus the panty hose will fit much better without stretching or sagging. The reduced length of the opening further allows for a narrower panty lower portion, thereby enhancing its improved fit.

The technique used for knitting at the opening in order to provide a linear opening has been amply detailed in the parent patent to which reference is made for the technical details. The difference in the method proposed for obtaining, for example, a rectangular opening is the following.

As mentioned in the parent patent, to provide a linear opening only two needles need be operated additionally, before and after the knitting of the opening, in order to connect together at the adjacent areas the two opposite flaps formed by two different sets of courses. On the other hand, to provide a rectangular opening, without changing the reciprocation stroke of the needle cylinder, i.e., equal approximately to 360° per stroke, all the needles corresponding to the width $L'_3$ (FIG. 2) of the knit-work being processed with the centerline of the opening coincident with the zero reference plane of the needle bed as described in the parent patent, are held inactive, with no thread held in them, during the whole processing of the portion $L'_2$, and are subsequently activated all together as soon as the portion $L'_1$ is completed which corresponds to the opening.

It would appear that with this technique one of the primary advantages of the parent patent invention has been lost, i.e., the utilization of substantially all the needles at each stroke of the cylinder. Actually, by inactivating said needles at the portion $L'_3$ an economy is achieved, since a length of knit-work is no longer required which in the prior art where the opening is cut with a subsequent step to the knitting, would have to be discarded anyhow.

As a matter of fact, the ideal opening to be cut in a completely closed tube would obviously be, rather than a straight cut, a wide ellipse, matching the human waist whereto the panty hose should fit, so that the whole surrounding knit-work adheres to the body with a minimum of deformation. The rectangular opening approaches an ellipse much more than a linear cut, and renders thus unnecessary the knitting of a portion which, ideally, should not be there.

Figure 3:
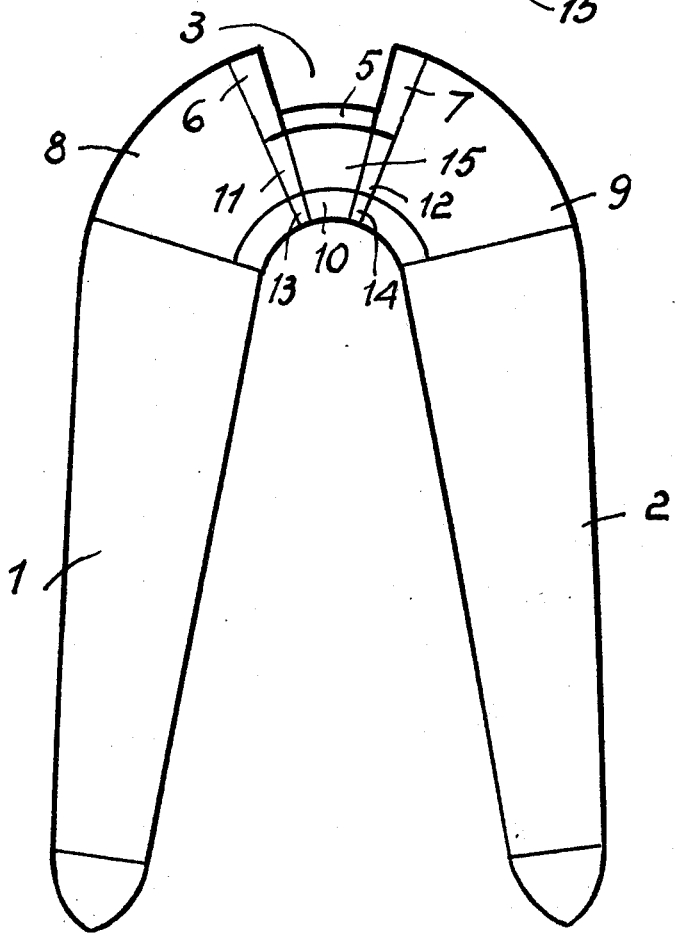
FIG. 3 shows schematically the variously knitted panels of a preferred embodiment of the invention.

A method will be now described, by way of example, for manufacturing the improved panty hose according to the invention, referring particularly to FIG. 3. As it is usual, knitting starts with the toe of a first leg part 1, using a thin yarn, such as a synthetic fiber known as "Filanca" (registered trademark), with a continuous rotary motion and forming complete courses. Where the portion 8 begins a coarser thread is used, e.g., of the same material, and a more dense fabric is knitted again with a continuous rotary motion until the portion 6 is reached. At this moment, the needle cylinder is caused to reciprocate. The portion 6 is formed partially with elastic knit-work so textured as to impart resiliency in a direction substantially transversal to the knitted tube. To this end, the elastic yarn may be plaited or interlaced using known techniques. According to a preferred embodiment, it is contemplated that the elastic yarn be arranged to form, in the same direction of the courses across the tube one loop every two or three loops of the yarn used for manufacturing the panty portion, hereinafter called body yarn. Owing to the reciprocating motion, the elastic yarn arranges itself continuously across the entire transverse extension of the portion 6, with two free ends, one respectively at the beginning of the portion 6, resulting from fresh yarn previously cut and now introduced into the fabric, and one at the termination of portion 6, resulting from yarn cutting and withdrawal thereof from the path of the working needles.

According to another advantageous embodiment, the formation of a double fabric like a double thickness welt-like portion is provided for a certain part of the height of the portion 6, said fabric being formed as a conventional welt-like portion by holding loops on welt of the welt dial and knitting with the needles of an arc of the needle cylinder corresponding to L'3 and finally transferring the held loops from the welt hooks back to the needles before inactivation thereof.

The portions 11 and 13 along the same circumference of portion 6 are knitted with a yarn like to that of portion 8. Advantageously, the portion 6 may be made with some courses of body yarn and some courses of rubber thread or elastic yarn, whereas the portions 11 and 13 may be of body yarn.

Subsequently, again in the reciprocating mode, the portions 4 and 5, and the panels 15 and 10 are knitted. To inform these portions, as already described, a number of adjacent needles corresponding to an arc of the needle cylinder equal to L'3 are inactivated and partial courses are knitted, while the needles adjacent to the inactivated needles are controlled to form at the end of each stroke of reciprocation a corresponding one of two knit selvage edges transversally spaced apart by an extent equal to L'3. The portions 4 and 5 may be composed with elastic yarn and body yarn, the elastic yarn being, for example, knitted with the technique disclosed in U.S. Pat. No. 3,924,423 for the longitudinal portions adjacent the linear opening. According to a preferred embodiment, the elastic yarn is inserted so as to have two courses of normal yarn alternating to two courses of elastic yarn.

The panels 15 (the panel shown in FIG. 3 and the panel arranged symmetrical with respect to the former, shown in FIG. 2) are knitted with a single yarn, e.g., body yarn, similarly to portion 8, whereas the lower panty area panel 10 is preferably made of a fabric having held loops, thereby biasing the panel to contract. Advantageously, for reasons of hygiene and in order to make the contracted area softer, the panel 10 may be of cotton yarn.

Thereafter, the remaining portions 7, 12, 14, 9 and 2 are obtained substantially in the same way as the corresponding portions in the other half of the panty hose just described.

With the plaiting or interlacing of the elastic yarn along the edges of the opening 3 during the reciprocating motion of the needle cylinder, as described hereinabove, a specially satisfactory solution is provided for the problem of how to manufacture an edge that is elastic, continuous, economical, well fitting and above all non-unravelled, i.e., without free yarn ends for each knitted course around the opening.

Obviously, many variations and modifications may be introduced by the experts which fall within the scope of the present invention.

I claim:

1. A method for manufacturing seamless panty hose having a tubular panty portion with a waist opening and two legs integral with said panty portion on a circular hosiery knitting machine having a needle cylinder, the method including the steps of knitting a first of said legs by continuously rotating said needle cylinder and forming complete courses, knitting a panty portion adjacent said waist opening by reciprocating said needle cylinder, inactivating a number of adjacent needles at the end of each of a number of consecutive strokes of reciprocation to form partial courses and controlling the needles adjacent said number of inactivated needles to form at said end of each of said strokes of reciprocation a corresponding one of two transversally spaced apart knit selvage edges, thereby defining a waist opening which extends transversally to the tubular panty portion by an extent substantially corresponding to the arc occupied by said inactivated needles and longitudinally by an extent proportioned to said transverse extension, activating said inactivate number of adjacent needles and knitting a second of said legs by continuously rotating said needle cylinder and forming complete courses.

2. A method according to claim 1, comprising the step of knitting some courses before inactivating said number of adjacent needles partially with an elastic yarn and with a body yarn, said elastic yarn being knitted so as to impart resiliency substantially in a transversal direction to the knitted tube, and further comprising the step of knitting portions adjacent said waist opening partially with an elastic yarn and a body yarn to define selvage edges made of loops of elastic yarn and of loops of body yarn, and finally knitting some courses after having newly activated said inactivated needles partially with an elastic yarn and with a body yarn, said elastic yarn being knitted so as to confer resiliency substantially in a direction transversal to the tubular panty portion.

* * * * *